US005271302A

United States Patent [19]

Weis et al.

[11] Patent Number: 5,271,302

[45] Date of Patent: Dec. 21, 1993

[54] METHOD AND MEANS FOR CUTTING A WEB

[75] Inventors: Manfred Weis, Düsseldorf; Karl Thievessen, Grevenbroich; Ewald G. Welp, Erkrath, all of Fed. Rep. of Germany

[73] Assignee: Jagenberg Aktiengesellschaft, Düsseldorf, Fed. Rep. of Germany

[21] Appl. No.: 768,980

[22] PCT Filed: Jan. 24, 1991

[86] PCT No.: PCT/EP91/00138

§ 371 Date: Oct. 3, 1991

§ 102(e) Date: Oct. 3, 1991

[87] PCT Pub. No.: WO91/12118

PCT Pub. Date: Aug. 22, 1991

[30] Foreign Application Priority Data

Feb. 8, 1990 [DE] Fed. Rep. of Germany ..... 4003801

[51] Int. Cl.[5] ..... B26D 1/18

[52] U.S. Cl. ..... 83/56; 83/485; 83/595; 83/835

[58] Field of Search ..... 83/854, 835, 471.2, 83/13, 594, 595, 596, 607, 675, 485, 56; 223/3

[56] References Cited

U.S. PATENT DOCUMENTS

| | | | |
|---|---|---|---|
| 558,466 | 4/1896 | Bowles | 83/854 |
| 1,766,327 | 6/1930 | Bruton | 83/595 X |
| 1,968,688 | 7/1934 | Katz et al. | 83/591 X |
| 2,048,702 | 7/1936 | Joy | 83/854 X |
| 2,160,525 | 5/1939 | Thornton | 144/235 |
| 3,700,016 | 10/1972 | Strobel | 83/848 |
| 3,885,488 | 5/1975 | Evancic et al. | 83/835 |
| 4,043,366 | 8/1977 | Palleri | 83/675 X |
| 4,480,518 | 11/1984 | Futterer | 83/508 |

FOREIGN PATENT DOCUMENTS

| | | |
|---|---|---|
| 2650355B | 4/1978 | Fed. Rep. of Germany . |
| 3638777C2 | 1/1989 | Fed. Rep. of Germany . |
| 4003801C1 | 3/1991 | Fed. Rep. of Germany . |
| 2167998 | 6/1986 | United Kingdom . |

*Primary Examiner*—Frank T. Yost
*Assistant Examiner*—Kenneth E. Peterson
*Attorney, Agent, or Firm*—Herbert Dubno

[57] ABSTRACT

For the cutting of a web a circular cutter is journaled rotatably in a slide which is moved along the cutting line by means of a linear drive. The cutter has a disk-shaped base body journaled freely rotatable which upon its perimeter is provided with pointed cutting blades angled in the sense of rotation. The distance of the base body from the web is chosen such that only the cutting blades but not the base body penetrate the web. Furthermore, the cutting blades are so fashioned and arranged that upon their penetration of the web to the maximal depth of penetration, an uncut portion remains between two cutting blades which upon exit of the subsequent cutting blades is severed by their leading cutting edge.

4 Claims, 4 Drawing Sheets

METHOD AND MEANS FOR CUTTING A WEB

CROSS REFERENCE TO RELATED APPLICATIONS

This application is a national phase of PCT/EP91/00138 filed 24 Jan. 1991 and based, in turn, upon German National Application P 40 03 801.7 filed 8 Feb. 1990 under the International Convention.

FIELD OF THE INVENTION

The invention relates to a method of severing a web of material, specifically a paper or cardboard web, where a cutting means of circular shape, journaled rotatably in a slide, is moved along a cutting line by means of a linear drive. The invention also relates to a cutting means for the implementation of the method.

BACKGROUND OF THE INVENTION

In web-handling machinery, e.g. winding and unwinding machines for cardboard or paper webs, it is necessary during replacement of rolls to sever the webs transversely in a reliable manner.

For this purpose, various cutting means are utilized, depending on the weight per area of the web, which exhibit various disadvantages Thus, fixed blades fastened upon a knife slide must be replaced frequently because of wear, cutting beams with toothed knives require very high cutting forces, and driven circular knives utilized for high web weights per unit area require in addition to the linear drive for this procedure an additional rotary drive.

In order to avoid the need for a rotary drive for a driven circular knife, a transverse cutter is proposed in DE-PS 36 38 777, which has a wheel rigidly connected to a knife shaft and which rolls along a rod running parallel to the track of the slide carrying the knife. Due to the geometric and friction interaction between wheel and rod a rotary motion is imparted to the circular blade by the linear motion of the slide carrying the knife.

OBJECT OF THE INVENTION

It is the object of the invention to improve upon earlier methods and apparatus for cutting ga web so that the cutting of webs of materials of varying weights per unit area is simplified.

SUMMARY OF THE INVENTION

This object is attained in a method of severing a web, particularly of paper or cardboard, whereby a circular cutting blade journaled rotatably in a slide is moved by a linear drive along the cutting line. According to the invention, the cutting blade consists of a rotationally journaled disk-shaped base body, which is tipped on its entire perimeter with pointed knife blades angled in the sense of rotation. The distance from the slide to the web is so chosen that only the knife blades penetrate the web and note the base body. The knife blades are further so shaped and arranged that upon their penetration of the web to the maximal depth of penetration an uncut section remains between two cutting blades, which is severed upon the exit of the succeeding cutting blade by its leading cutting edge.

The apparatus thus is characterized by the fact that the cutting means consists of a disk-shaped base body journaled freely rotatable, which upon its entire perimeter is provided with pointed cutting blades angled in the sense of rotation, whereby the distance between the slide and the web is so chosen that only the cutting blades not the base body penetrate the web, and that furthermore the cutting blades are so shaped and arrayed that upon penetration of the web up to the maximal depth of penetration, an uncut section remains between two cutting blades, which is severed upon exit of the subsequent cutting blade by its leading cutting edge.

According to the invention, the knife blades only perforate upon penetration into the web, so that upon maximum depth of entry, there remain uncut bridges in the web between the knife blades. Only upon exiting from the web are these uncut bridges severed by the knife blades, so that the web is totally severed. Thus, a torque is produced on the circular cutting means by the knife blades being in the penetration phase due to the relative motion between web and the slide carrying the knives which suffices for the severance of the bridges by the exiting knife blades. Thus, the cutting means does not require a separate rotational drive nor power transmission elements which, as in the DE-PS 36 38 777 generate a torque for the cutting motion.

Preferably the base body or disk has at least 8, preferably 20 to 30 cutting blades. The angle between the radius at the point of the cutting blade and its leading cutting edge is 10° to 45°, preferably 15° to 25°. At least the leading cutting edge of each cutting blade is sharpened. The trailing edge of each cutting blade can be curved. The apparatus can also include a guide element or hold-down, fastened to the slide which holds the web at the desired distance from the slide during cutting.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
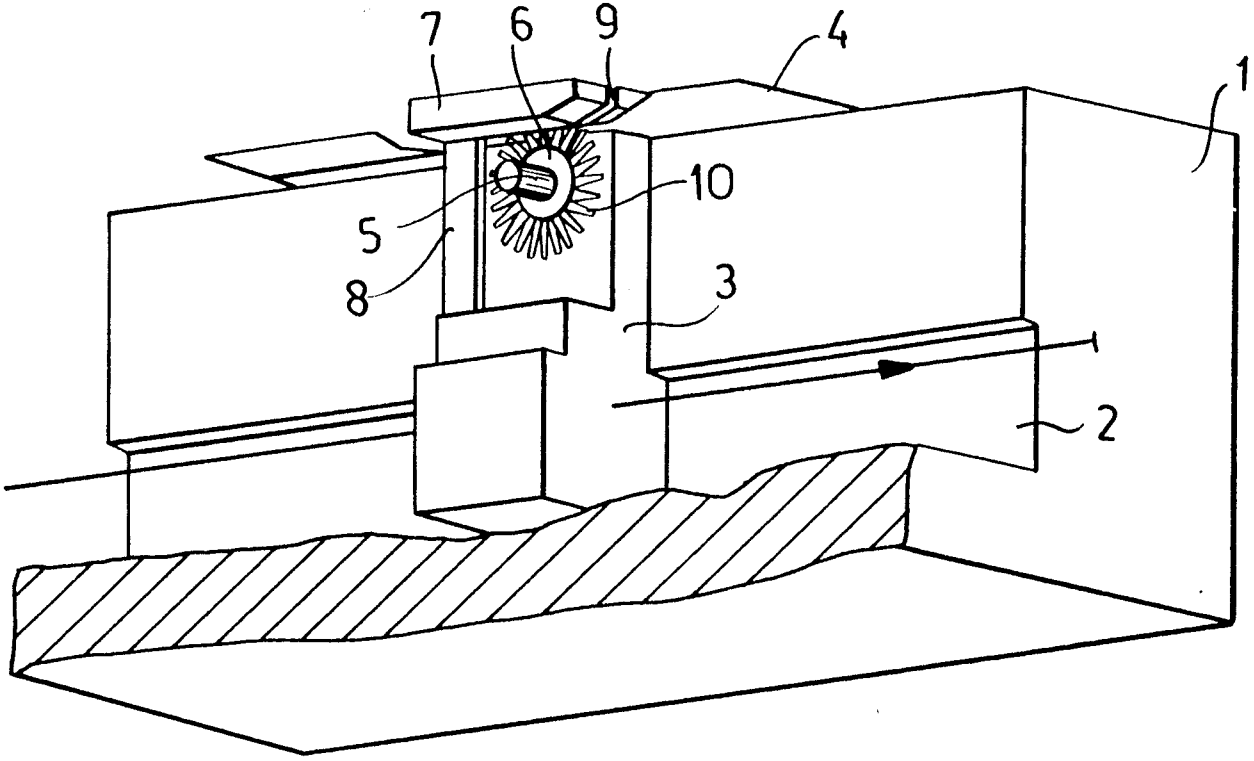
FIG. 1 is a perspective view, partly broken away, of a cutting apparatus according to the invention.
Figure 2:
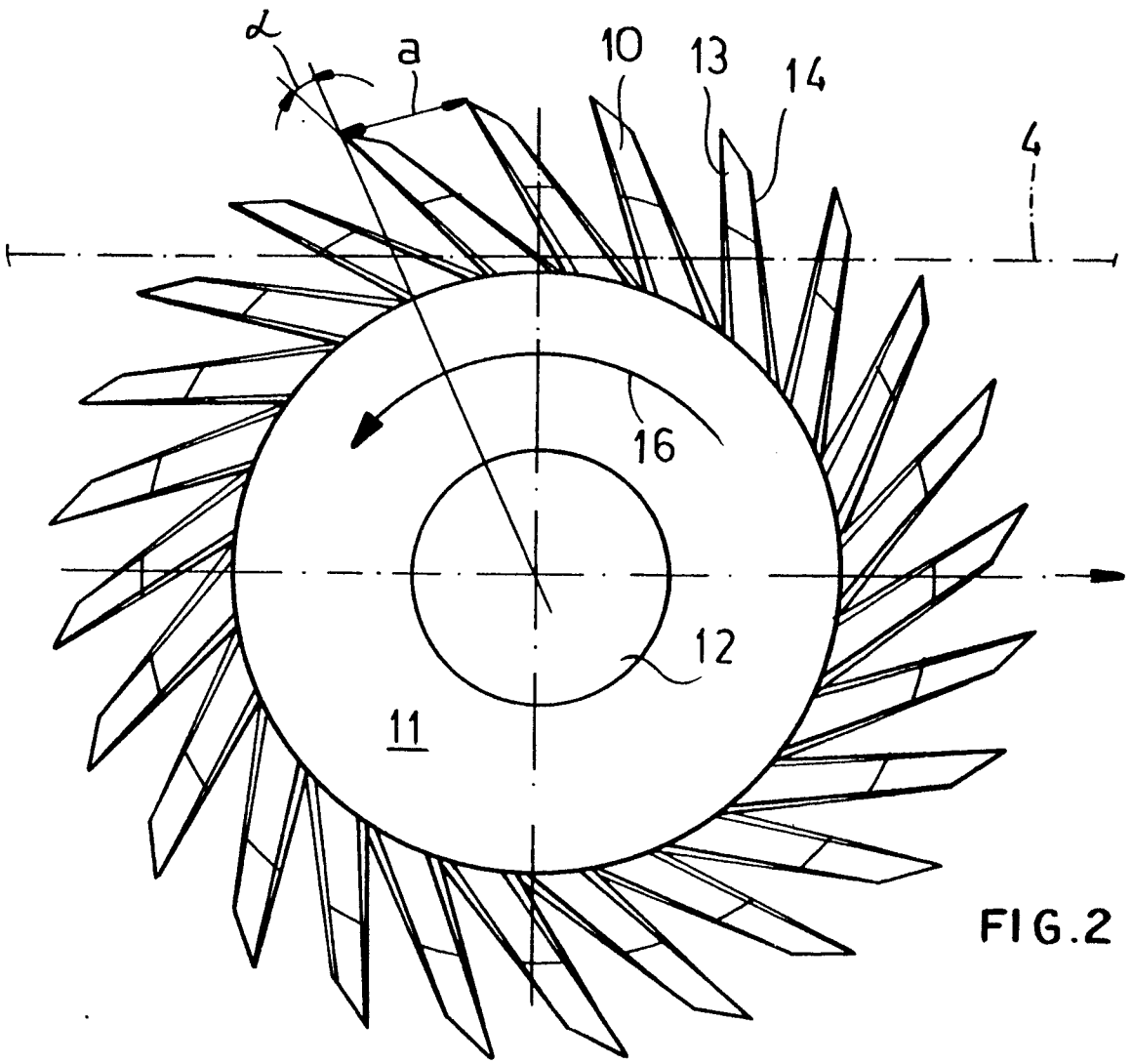
FIG. 2 is an enlarged elevational view of the cutting blade.
Figure 3:
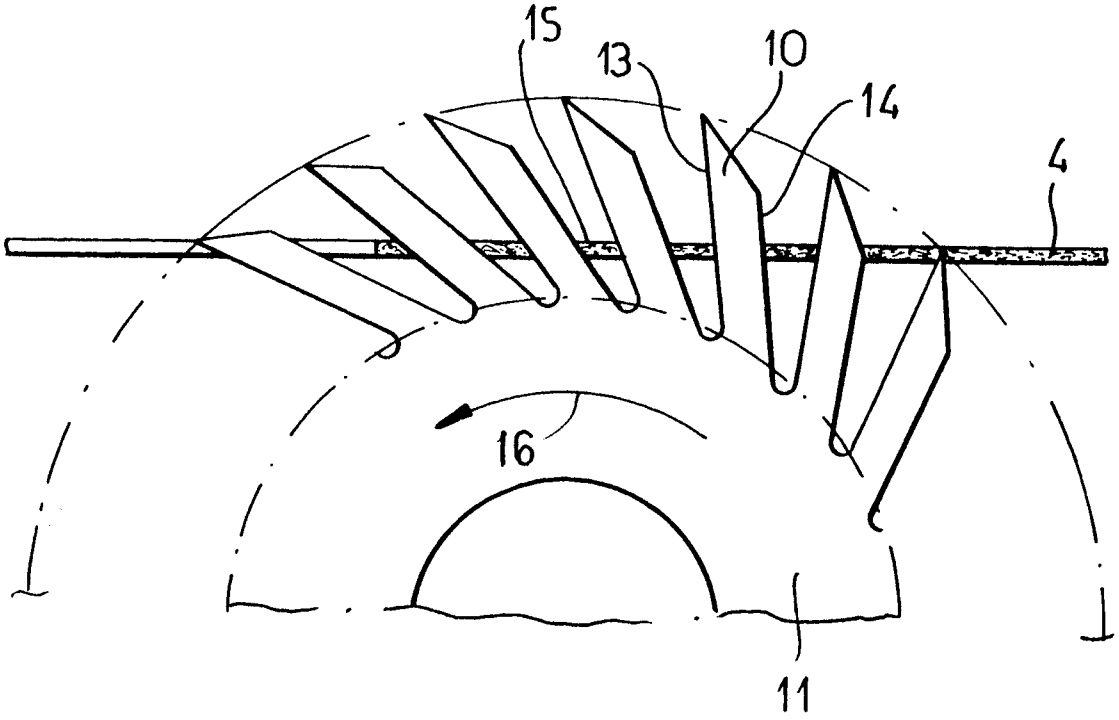
FIG. 3 is a diagram of the cutting process.
Figure 4:
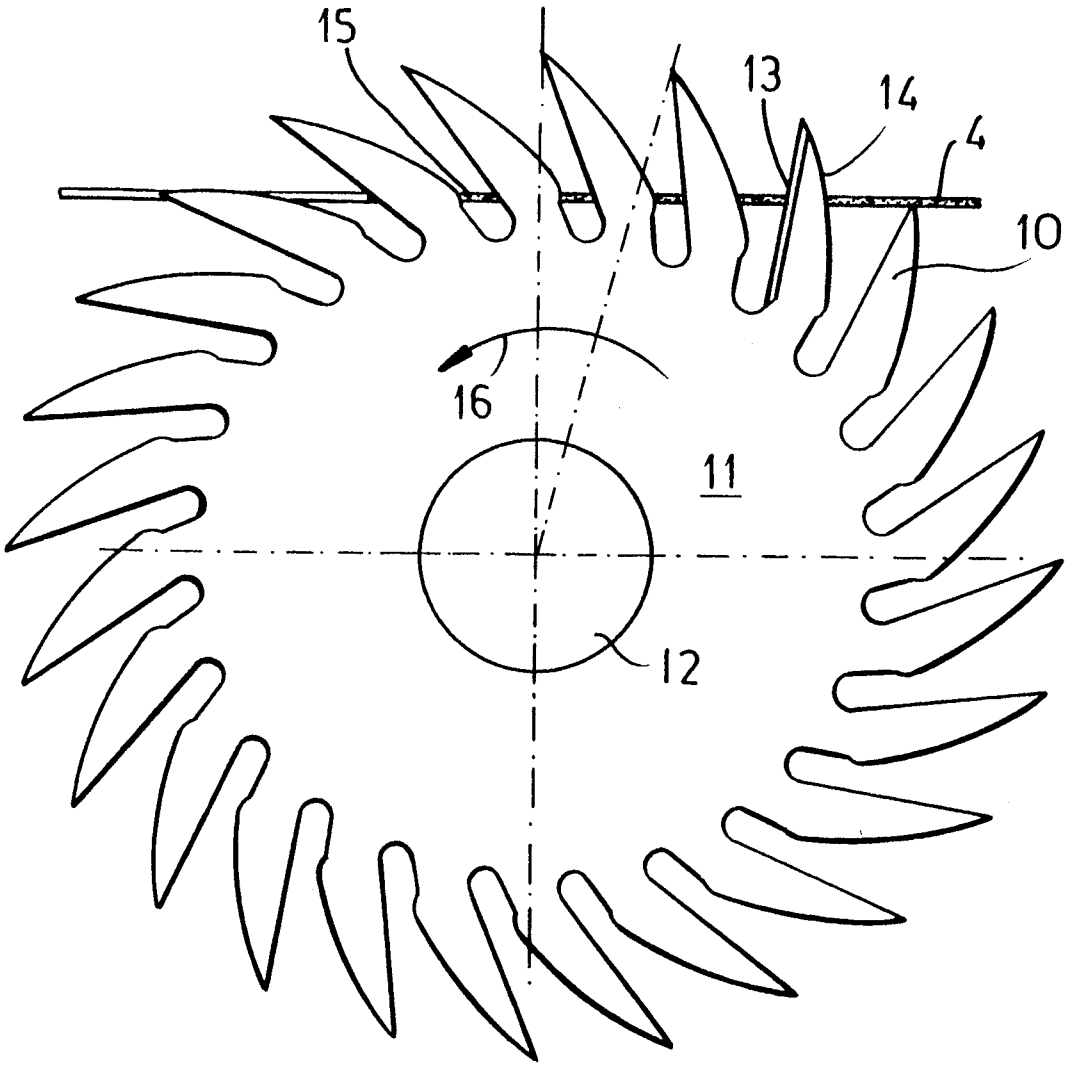
FIG. 4 is an elevational view of a cutting blade with knife blades with curved trailing cutting edges.

A guide groove 2 (FIG. 1) extending over the width of the work is provided in a beam 1 wherein transversely translatable slide 3 carrying a knife is supported. The slide carrying the knife is terminated on the upper side by the beam 1 and thus provides a guide surface for the web 4, in the present case a paper web. On the side facing away from the beam 1 a pivot 5, upon which a cutting means 6 shown in detail in FIGS. 2 to 4 is journalled so as to be freely rotatable, is fastened to the knife-carrying slide. A holddown 7 serves to let the web 4 approach the cutting means 6 and to support the web 4 during cutting, which is fastened to a loop-shaped extension 8 of the slide 3 carrying the knife, and has a slot 9, into which the knife blades 10 of the cutter 6 protrude during the cutting of the web.

The cutter 6 in both embodiments has a disk-shaped base body 11 with a central circular bore 12 receiving the pivot shaft 5 upon which the base body 11 can rotate freely. Outwardly extending pointed knife blades 10 are fastened to the entire perimeter of base body 11, inclined in the sense of rotation of the base body 11. The angle $\alpha$ between the radius to the point of the knife blade 10 and the sharpened or ground leading cutting edge 13 is between 10° and 45° preferably between 15° to 25°, in the present example 22°. The distance a between two points of the knife blades is shorter than the leading cutting edge 13, and on the perimeter of the base body 11 there are arrayed at least 8, preferably 20–30, in the present example 24 knife blades. The other dimensions in this embodiment are: diameter of the base body 11=22 mm, length of the knife blades=11 mm approx., distance a between knife points=5 mm approx.

In the embodiments of FIGS. 2 and 3, the trailing edge 14 of each knife blade 10 is straight, either only slightly inclined towards the front cutting edge 13 (FIG. 1) or parallel thereto (FIG. 3). In these embodiments the trailing edge 14 is also sharpened.

In the preferred embodiment according to FIG. 4 only the leading cutting edge 13 of each knife blade 10 is sharpened. The trailing edge 14 is concavely curved in such manner that during penetration, it remains constantly in contact with the paper web 4. thus all of knife blades 10 during penetration support themselves permanently on web 4 by their trailing edges 14.

During the cutting process the web 4 is supported by the hold-down 7, which prevents a deviation of web 4 and thus determines the depth of penetration of the knife blades 10 at a fixed distance from slide 3. For cutting, the cutter 6 is moved by a straight-line drive parallel to web 4, in FIGS. 1 to 4 to the right. The position of web 4 is so chosen that only the knife blades 10, but not the base body 11 penetrate web 4. During penetration the knife blades cut the web 4 partially, so that at maximal depth of penetration, uncut web sections 15 remain between adjacent cutting blades 10, which only upon exit of the cutting blades 10 are severed completely by the leading cutting edges 13 as shown to the left in FIGS. 3 and 4. In the embodiments of FIGS. 2 and 3, the sharpened trailing cutting edges 14 cut upon penetration. In the embodiment of FIG. 4, it is the leading cutting edges 13 which cut. In FIGS. 2 to 4, the penetration phase of the knife blades 10 is shown in the right half, the exit phase in the left half. Due to the relative motion between web 4 and the cutting blades 10 in the penetration phase a torque in the direction of arrow 16 is generated in the freely rotatable base body 11, which leads to a rotary motion of the cutter 6. Due to this torque, the exiting cutting blades 10 are in the position to sever the remaining uncut portions 15 of web 4 with the leading cutting edges 13, so that the web is completely cut. The cutting means thus needs no additional rotary drive in order to cut web 4 completely with a rotary motion.

In the preferred embodiment according to FIG. 4, during the penetration phase the trailing edges 14 stay permanently in contact with paper web 4 because of their curvature. Therefore, the knife blades 10, (which are) in the penetration phase, transfer a steady torque to the knife blades 10 which are in the exit phase, whereby a jerky cutting motion is avoided. The load generated by the derivation of a rotary motion of the cutting means 6 from the linear motion of slide 3 is evenly distributed upon the range where the knife blades 10 are in the penetration phase. Excessive local stresses which could e.g. lead to undesired tears, are avoided.

We claim:

1. A method of severing a web, comprising the steps of:

(a) mounting a cutter for free rotation about an axis on a slide and providing said cutter with a disk-shaped base body centered on said axis and a peripheral array of pointed knife blades extending outwardly from said disk-shaped base body, angled toward respective radii running from the axis to a point of the respective knife blade in a sense of rotation of the cutter;

(b) piercing said pointed knife blades in succession into said web at a distance of said axis from said web such that only the knife blades penetrate into said web while said base body remains outside of said web;

(c) moving said slide all across a width of said web, thereby successively penetrating said web with each knife blade to a maximum depth and thereafter swing said knife blade out of said web, whereby an uncut section remains between knife blades upon penetration of said web to said maximum depth and each uncut section is thereafter severed by a leading cutting edge of a succeeding knife blade; and (d) inducing rotation of said cutter exclusively by engagement of said web with said knife blades as said slide is moved across the width of the web.

2. An apparatus for severing a web, comprising:

a slide movable across a width of a web to be severed;

a cutter mounted for free rotation about an axis on said slide, said cutter being provided with:

a disk-shaped base body centered on said axis and a peripheral array of 20 to 30 pointed knife blades extending outwardly from said disk-shaped base body, angled toward respective radii running from the axis to a point of the respective knife blade in a sense of rotation of the cutter, each of said knife blades being formed with a respective leading cutting edges forming an angle $\alpha$ of 15° to 25° with the respective radius at the respective point, said cutter being positioned for piercing said pointed knife blades in succession into said web at a distance of said axis from said web such that only the knife blades penetrate into said web while said base body remains outside of said web, said slide being movable all across a width of said web, thereby successively penetrating said web with each knife blade to a maximum depth and thereafter swinging said knife blade out of said web, whereby an uncut section remains between knife blades upon penetration of said web to said maximum depth and each uncut section is thereafter severed by a leading cutting edge of a succeeding knife blade, and movement of said slide across said width of said web inducing rotation of said cutter exclusively by engagement of said web with said knife blades as said slide is moved across the width of the web; and a hold-down device on said slide maintaining a predetermined distance of said web from said axis.

3. The apparatus defined in claim 2 wherein each of said leading cutting edges is a sharpened edge.

4. The apparatus defined in claim 2 wherein each of said knife blades has a curved trailing edge.

* * * * *